US009556406B2

(12) United States Patent
Torres et al.

(10) Patent No.: US 9,556,406 B2
(45) **Date of Patent: *Jan. 31, 2017**

(54) COMPOSITIONS COMPRISING BENEFIT AGENT AND APROTIC SOLVENT

(71) Applicant: Milliken & Company, Spartanburg, SC (US)

(72) Inventors: Eduardo Torres, Boiling Springs, SC (US); Sanjeev Kumar Dey, Spartanburg, SC (US); John David Bruhnke, Spartanburg, SC (US); Gregory Scot Miracle, Liberty Township, OH (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/597,370

(22) Filed: Jan. 15, 2015

(65) Prior Publication Data

US 2015/0232789 A1 Aug. 20, 2015

Related U.S. Application Data

(60) Provisional application No. 61/941,536, filed on Feb. 19, 2014.

(51) Int. Cl.

| | |
|---|---|
| ***C11D 3/20*** | (2006.01) |
| ***C11D 3/40*** | (2006.01) |
| ***C11D 3/42*** | (2006.01) |
| ***C11D 3/34*** | (2006.01) |
| ***C11D 11/00*** | (2006.01) |
| ***C11D 3/43*** | (2006.01) |
| ***C11D 3/50*** | (2006.01) |

(52) U.S. Cl.

CPC ..... *C11D 3/42* (2013.01); *C11D 3/2093* (2013.01); *C11D 3/349* (2013.01); *C11D 3/40* (2013.01); *C11D 3/43* (2013.01); *C11D 3/50* (2013.01); *C11D 11/0017* (2013.01)

(58) Field of Classification Search

CPC ..... C11D 3/20; C11D 3/2068; C11D 3/2093; C11D 3/40; C11D 3/42

See application file for complete search history.

(56) References Cited

U.S. PATENT DOCUMENTS 4,271,031 A * 6/1981 Oppenlaender ..... C11D 1/66 252/407

FOREIGN PATENT DOCUMENTS

| | | | | |
|---|---|---|---|---|
| CA | 2 311 994 A1 | | 12/2000 | |
| GB | 2 353 807 A | | 3/2001 | |
| GB | 2353807 | * | 3/2001 | ..... D06M 13/463 |
| WO | WO 02/14460 A2 | | 2/2002 | |
| WO | WO 2006/076454 A1 | | 7/2006 | |
| WO | WO 2010/145887 | * | 12/2010 | ..... C11D 3/40 |
| WO | WO 2010/145887 A1 | | 12/2010 | |
| WO | WO 2012/166768 | * | 12/2012 | ..... C11D 3/40 |
| WO | WO 2012/166768 A1 | | 12/2012 | |

OTHER PUBLICATIONS

International Search Report; International application No. PCT/US2015/011983; International filing date Jan. 20, 2015.

* cited by examiner

*Primary Examiner* — Brian P Mruk
(74) *Attorney, Agent, or Firm* — Brenda D. Wentz

(57) ABSTRACT

Composition comprising a benefit agent and an aprotic solvent, wherein the benefit agent comprises at least one nucleophilically and/or hydrolytically unstable bond.

14 Claims, No Drawings

COMPOSITIONS COMPRISING BENEFIT AGENT AND APROTIC SOLVENT

CROSS-REFERENCE TO RELATED APPLICATIONS

This application claims priority to and the benefit of U.S. Patent Application Ser. No. 61/941,536, entitled "Composition Comprising Benefit Agent and Aprotic Solvent," which was filed on Feb. 19, 2014, and which is entirely incorporated by reference herein.

BACKGROUND

Many compositions, including consumer good products comprise benefit agents. Benefit agents provide a consumer desired benefit, however often they are susceptible to hydrolysis by other components present in the product. This results in breakdown and loss of the benefit agent during storage which negatively impacts the consumer experience when they come to use the product. The consumer prefers to get consistent performance from the product across the lifetime of the product usage. If benefit agents are breaking down upon storage, the consumer experience can be unpredictable and dissatisfying.

Therefore, there is a need in the art for a composition that provides improved benefit agent stability.

The Inventors have surprisingly found that the stability of benefit agents having at least one hydrolytically unstable bond in compositions can be improved by the presence of specific solvents, namely aprotic solvents.

SUMMARY OF THE INVENTION

The present invention is directed to a composition comprising;

a. a benefit agent, wherein the benefit agent contains at least one nucleophilically unstable bond; and b. an aprotic solvent, preferably wherein the aprotic solvent has a molecular weight of between 70 and 2500, or even between 90 and 2000, or even between 100 and 1750, or even between 100 and 1500.

The present invention is also directed to a composition comprising;

a. a benefit agent, wherein the benefit agent comprises at least one hydrolytically unstable bond; and b. an aprotic solvent, preferably wherein the aprotic solvent has a molecular weight of between 70 and 250, or even between 90 and 200, or even between 100 and 175, or even between 100 and 150.

The present invention is further directed to a detergent composition comprising;

a. a benefit agent, wherein the benefit agent comprises at least one hydrolytically unstable bond;

b. an aprotic solvent, preferably wherein the aprotic solvent has a molecular weight of between 70 and 250, or even between 90 and 200, or even between 100 and 175, or even between 100 and 150;

c. a detergent adjunct ingredient.

The present invention also contemplates a method of making a composition according to the present invention, wherein the composition is prepared by;

a) Obtaining a pre-mix comprising the benefit agent and the aprotic solvent;

b) mixing the pre-mix with the adjunct ingredient;

c) Optionally adding one or more further ingredients in one or more further steps;

d) Collecting the final composition.

The present invention also contemplates the use of an aprotic solvent to improve the stability of a benefit agent wherein the benefit agent comprises at least one nucleophilic ally and/or hydrolytically unstable bond.

DETAILED DESCRIPTION OF THE INVENTION

Detergent Composition

The detergent composition of the present invention comprises;

a. a benefit agent, wherein the benefit agent comprises at least one hydrolytically unstable bond;

b. an aprotic solvent, preferably wherein the aprotic solvent has a molecular weight of between 70 and 250, or even between 90 and 200, or even between 100 and 175, or even between 100 and 150;

c. a detergent adjunct ingredient.

The detergent composition of the present invention may be a fully formulated laundry product, such as a laundry detergent composition. Alternatively, it may be a composition that is added to other components in order to make a fully formulated laundry product.

The composition when dissolved in 9 parts of water (where the composition is 1 part) gives a pH between 4 and 11, or even between 5 and 10, or even between 6 and 9, or even between 6.5 to 8.5.

The composition may be a liquid or a granular or solid composition.

Liquids include liquids, gels, pastes, dispersions and the like.

The detergent composition may be a granular laundry detergent composition. The granules may be spray-dried, agglomerated or extruded for example. Preferably the benefit agent and aprotic solvent are present in the same particle.

The detergent composition may be in the form of a unit dose article. The unit dose article of the present invention comprises a water-soluble film which fully encloses a detergent composition in at least one compartment.

Suitable detergent compositions include, but are not limited to, consumer products such as: products for treating fabrics, hard surfaces and any other surfaces in the area of fabric and home care, including: dishwashing, laundry cleaning, laundry and rinse additives, and hard surface cleaning including floor and toilet bowl cleaners.

A particularly preferred embodiment of the invention is a "liquid laundry treatment composition". As used herein, "liquid laundry treatment composition" refers to any laundry treatment composition comprising a liquid capable of wetting and treating fabric e.g., cleaning clothing in a domestic washing machine. The liquid composition can include solids or gases in suitably subdivided form, but the liquid composition excludes forms which are non-fluid overall, such as tablets or granules. A liquid composition includes liquids, gels, pastes, dispersions and the like. The liquid compositions preferably have densities in the range from of 0.9 to 1.3 grams per cubic centimeter, more preferably from 1.00 to 1.1 grams per cubic centimeter, excluding any solid additives, but including any bubbles, if present.

When the detergent composition is a unit dose article, the unit dose article comprises a water-soluble film which fully encloses the detergent composition in at least one compartment. The detergent composition may be a solid, liquid, gel, fluid, dispersion or a mixture thereof. The unit dose article can be of any form, shape and material which is suitable for holding the detergent composition, i.e. without allowing the release of the composition, and any additional component, from the unit dose article prior to contact of the unit dose article with water. The exact execution will depend, for example, on the type and amount of the detergent compositions in the unit dose article, the number of compartments in the unit dose article, and on the characteristics required from the unit dose article to hold, protect and deliver or release the detergent compositions or components.

The unit dose article may optionally comprise additional compartments; said additional compartments may comprise an additional composition. Alternatively, any additional solid component may be suspended in a liquid-filled compartment. A multi-compartment unit dose form may be desirable for such reasons as: separating chemically incompatible ingredients; or where it is desirable for a portion of the ingredients to be released into the wash earlier or later. The unit dose article may comprise at least one, or even at least two, or even at least three, or even at least four, or even at least five compartments. The multiple compartments may be arranged in any suitable orientation. For example they may be arranged in a superposed orientation, in which one compartment is position on top of another compartment. Alternatively, they may be position in a side-by-side arrangement. In such an arrangement the compartments may be connected to one another and share a dividing wall, or may be substantially separated and simple held together by a connector or bridge. Alternatively, the compartments may be arranged in a 'tyre and rim' orientation, i.e. a first compartment is positioned next to a second compartment, but the first compartment at least partially surrounds the second compartment, but does not completely enclose the second compartment.

Preferably, the weight ratio of aprotic solvent to benefit agent is from 2:1 or even from 4:1, or even from 5:1, or even from 6:1, to 8:1, or to 100:1, or to 250:1.

Preferably, the aprotic solvent is propylene glycol carbonate, and the benefit agent is a shading dye.

Without wishing to be bound by theory, it is believed that it is specifically the presence of a specific solvent, i.e. it is the aprotic solvent that improves the stability of the benefit agent.

Benefit Agent

The composition of the present invention comprises a benefit agent, wherein the benefit agent comprises at least one nucleophilically and/or hydrolytically unstable bond. The term "nucleophilically" refers to any moiety (e.g. a nucleophile) that is capable of donating an electron pair.

In one aspect, the nucleophilically unstable bond is of the formula X—Y, wherein at least one of X and/or Y are a heteroatom, that can hydrolyze to yield:

(a) X—OH and $CO_2$ and HM-Y or X—OH and H—Y, wherein M=O, N, or S, or (b) X-Nu and H—Y where Nu=Heteroatom-$R_xR_yR_z$, wherein x, y, z are integers independently selected from 0 or 1 and $x+y+z \geq 1$, and wherein Rx, $R_y$ and $R_z$ are independently selected from the group consisting of H, alkyl, alkoxy, alkyleneoxy, alkyl capped alkyleneoxy, polyalkyleneoxy, alkyl capped polyalkyleneoxy, urea, or amido.

In another aspect, the nucleophilically unstable bond is of the formula X—Y—Z, wherein at least one of X and/or Z are a heteroatom, that can hydrolyze to yield X—Y—OH and H—Z or X—Y-Nu and H—Z wherein Nu=Heteroatom-$R_xR_yR_z$, wherein x, y, z are integers independently selected from 0 or 1 and $x+y+z \geq 1$, wherein Rx, $R_y$ and $R_z$ are independently selected from the group consisting of H, alkyl, alkoxy, alkyleneoxy, alkyl capped alkyleneoxy, polyalkyleneoxy, alkyl capped polyalkyleneoxy, urea, or amido, and wherein Y is selected from alkyl, carbocycle, heterocycle, aromatic, or heteroaromatic groups.

In yet another aspect, the nucleophilically unstable bond is of the formula A-X—Y—B, wherein A is the benefit agent and B is selected from alkyl, polyoxyalkylene, polyester, polyamide, aryl, heteroaryl and polyoxyalkylene substituted aryl.

The nucleophilically unstable bond is selected from esters, thioesters and amides of organic acids, halides, sulfates, sulfonates, phosphates, phosphonates, thioureas, thiosulfates, xanthates, vinyl sulfones, carbamates and carbonates.

The hydrolytically unstable bond may be of the formula X—Y, wherein at least one of X and/or Y are a heteroatom, that can hydrolyze to yield X—OH and H—Y. Preferably, the hydrolytically unstable bond is selected from esters, thioesters and amides of organic acids.

The benefit agent may be selected from dyes, shading dyes, perfumes, fragrances, enzymes, polymers, UV absorbers, fluorescent whitening agents, antioxidants, photostabilizers, surfactants, bleach activators, bleaching agents, photobleaches, fabric softeners, builders, clays, humectants, peracid generators, and mixtures thereof. Alternatively, the benefit agent may be selected from dyes, shading dyes, perfumes, polymers, surfactants and mixtures thereof. The benefit agent may be selected from dyes, shading dyes and perfumes, and mixtures thereof. In another embodiment, the benefit agent is a shading dye.

The benefit agent may be any shading dye having a hydrolytically unstable bond, optionally in combination with one or more additional dyes. Preferably the shading dye is a blue or violet shading dye. Preferably, the shading dye gives to a fabric a blue or violet colour with a hue angle of 240 to 345, preferably 260 to 320, most preferably 270 to 300, either alone or in combination with other shading dyes that may be present. It should be understood that wherein the benefit agent is a shading dye, the shading dye may be the purified shading dye, or may be the shading dye in combination with impurities from the synthesis of the shading dye. The weight ratio of the shading dye to any impurity or degradation product of the shading dye may be at least 3:1 or even 5:1, or even 10:1, or even 25:1.

The shading dye may comprise an anionic group covalently bound to an alkoxy group.

Shading dyes may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric shading dyes include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Acid, Direct, Basic, Reactive, Solvent or Disperse dyes for example that are classified as Blue, Violet, Red, Green or Black, and provide the desired shade either alone or in combination. Hydrolysed reactive dyes, for example as described in EP1794274, are also suitable. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in US 2008/034511 A1 or U.S. Pat. No. 8,268,016 B2, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Preferred dyes include dye polymers, wherein a dye group is bound to a polymeric group, optionally via a linking group. Suitable polymeric groups include, but are not limited to, (1) alkoxylated polyethyleneimine (for example as disclosed in WO2012119859), (2) polyvinyl alcohol (for example as disclosed in WO2012130492), or (3) diamine derivative of an alkylene oxide capped polyethylene glycol (for example as disclosed in WO2012126665, especially FIG. 24), or polyalkoxylated alcohol, for example as described in WO2011/011799, WO2012/054058, WO2012/166699 or WO2012/166768. One preferred class of dye polymers is obtainable by reacting a blue or violet dye containing an NH2 group with a polymer to form a covalent bond via the reacted NH2 group of the blue or violet dye and the dye polymer has an average of from 2 to 30, preferably 2 to 20, most preferably 2 to 15 repeating same units. In a preferred embodiment the monomeric units are selected from alkylene oxides, preferably ethylene oxides. Typically dye polymers will be in the form of a mixture of dye polymers in which there is a mixture of molecules having a distribution of number of monomer groups in the polymer chains, such as the mixture directly produced by the appropriate organic synthesis route, for example in the case of alkylene oxide polymers, the result of an alkoxylation reaction. Such dye polymers are typically blue or violet in colour, to give to the cloth a hue angle of 230 to 345, more preferably 250 to 330, most preferably 270 to 300, either alone or in combination with other shading dyes that may be present. In the synthesis of dye polymers unbound blue or violet organic dyes may be present in a mixture with the final dye-polymer product. The chromophore of the blue or violet dye is preferably selected from the group consisting of: azo; anthraquinone; phthalocyanine; triphendioxazine; and, triphenylmethane. In one aspect the dye polymer is obtainable by reacting a dye containing an NH or an NH2 group (herein referred to as NH[2]) with a polymer or suitable monomer that forms a polymer in situ. Preferably the NH[2] is covalently bound to an aromatic ring of the dye. Unbound dye is formed when the dye does not react with polymer, or even when a bound dye hydrolyzes from a polymer. Preferred dyes containing NH[2] groups for such reactions are selected from: acid violet 1; acid violet 3; acid violet 6; acid violet 11; acid violet 13; acid violet 14; acid violet 19; acid violet 20; acid violet 36; acid violet 36:1; acid violet 41; acid violet 42; acid violet 43; acid violet 50; acid violet 51; acid violet 63; acid violet 48; acid blue 25; acid blue 40; acid blue 40:1; acid blue 41; acid blue 45; acid blue 47; acid blue 49; acid blue 51; acid blue 53; acid blue 56; acid blue 61; acid blue 61:1; acid blue 62; acid blue 69; acid blue 78; acid blue 81:1; acid blue 92; acid blue 96; acid blue 108; acid blue 111; acid blue 215; acid blue 230; acid blue 277; acid blue 344; acid blue 1 17; acid blue 124; acid blue 129; acid blue 129:1; acid blue 138; acid blue 145; direct violet 99; direct violet 5; direct violet 72; direct violet 16; direct violet 78; direct violet 77; direct violet 83; food black 2; direct blue 33; direct blue 41; direct blue 22; direct blue 71; direct blue 72; direct blue 74; direct blue 75; direct blue 82; direct blue 96; direct blue 1 10; direct blue 111; direct blue 120; direct blue 120:1; direct blue 121; direct blue 122; direct blue 123; direct blue 124; direct blue 126; direct blue 127; direct blue 128; direct blue 129; direct blue 130; direct blue 132; direct blue 133; direct blue 135; direct blue 138; direct blue 140; direct blue 145; direct blue 148; direct blue 149; direct blue 159; direct blue 162; direct blue 163; food black 2; food black 1 wherein the acid amide group is replaced by NH[2]; Basic Violet 2; Basic Violet 5; Basic Violet 12; Basic Violet 14; Basic Violet 8; Basic Blue 12; Basic Blue 16; Basic Blue 17; Basic Blue 47; Basic Blue 99; disperse blue 1; disperse blue 5; disperse blue 6; disperse blue 9; disperse blue 1 1; disperse blue 19; disperse blue 20; disperse blue 28; disperse blue 40; disperse blue 56; disperse blue 60; disperse blue 81; disperse blue 83; disperse blue 87; disperse blue 104; disperse blue 1 18; disperse violet 1 disperse violet 4, disperse violet 8, disperse violet 17, disperse violet 26; disperse violet 28; solvent violet 26; solvent blue 12; solvent blue 13; solvent blue 18; solvent blue 68. Further preferred dyes are selected from mono-azo dyes which contain a phenyl group directly attached to the azo group, wherein the phenyl group has an NH[2] group covalently bound to it, for example a mono-azo thiophene dye. The polymer chain may be selected from polyalkylene oxides. The polymer chain and/or the dye chromophore group may optionally carry anionic or cationic groups. Examples of polyoxyalkylene oxide chains include ethylene oxide, propylene oxide, glycidol oxide, butylene oxide and mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in EP2534206, WO2012/163871, WO2012/130492, WO2012/126665, WO2012/119859, US2012/0225803, IN201200902, EP2488622, WO2012/098046, EP2440645, WO2010/145887, WO2011/098355, WO2011/098356, WO2011/082840, WO2011/047987, WO2011/148624 and WO2010/102861. In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

The shading dye maybe a polymeric azo dye or a polymeric thiophene dye.

Preferred hueing dyes include the whitening agents found in WO 08/87497 A1, WO2011/011799 and US 2012/129752 A1. Preferred shading dyes for use in the present invention may be the preferred dyes disclosed in these references, including those selected from Examples 1-42 in Table 5 of WO2011/011799. Other preferred dyes are disclosed in U.S. Pat. No. 8,138,222B2, especially claim 1 of U.S. Pat. No. 8,138,222B2. Other preferred dyes are disclosed in U.S. Pat. No. 7,909,890 B2.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect the composition may comprise a pigment. Suitable pigments include pigments selected from the group consisting of Ultramarine Blue (C.I. Pigment Blue 29), Ultramarine Violet (C.I. Pigment Violet 15) and mixtures thereof.

The shading dye may having the following structure:

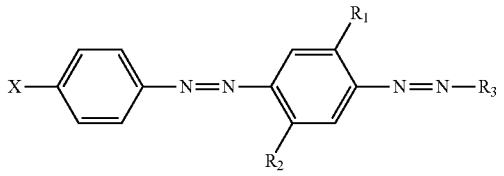

wherein:

$R_1$ and $R_2$ are independently selected from the group consisting of: H; alkyl; alkoxy; alkyleneoxy; alkyl capped alkyleneoxy; urea; and amido;

R3 is a substituted aryl group;

X is a substituted group comprising sulfonamide moiety and optionally an alkyl and/or aryl moiety, and wherein preferably the substituent group comprises at least one alkyleneoxy chain that comprises at least two, or even at least four alkyleneoxy moieties.

The shading dye may have the following structure:

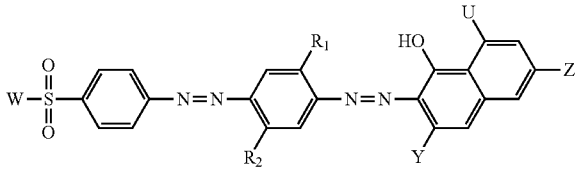

wherein:

$R_1$ and $R_2$ are independently selected from the group consisting of: H; alkyl; alkoxy; alkyleneoxy; alkyl capped alkyleneoxy; urea; and amido, preferably wherein $R_1$ is an alkoxy group and $R_2$ is an alkyl group;

U is a hydrogen, a substituted or unsubstituted amino group;

W is a substituted group comprising an amino moiety and optionally an alkyl and/or aryl moiety, and wherein the substituent group preferably comprises at least one alkyleneoxy chain that comprises at least two or even at least four alkyleneoxy moieties;

Y is a hydrogen or a sulfonic acid moiety; and

Z is a sulfonic acid moiety or an amino group substituted with an aryl group.

The shading dye may comprise a) a Zn-, Ca-, Mg-, Na-, K-, Al, Si-, Ti-, Ge-, Ga-, Zr-, In- or Sn-phthalocyanine compound of formula (1)

$$(PHC)\text{-}L\text{-}(D) \quad (1)$$

to which at least one mono-azo dyestuff is attached through a covalent bonding via a linking group L wherein PHC is a metal-containing phthalocyanine ring system;

D is the radical of a mono-azo dyestuff; and

L is a group

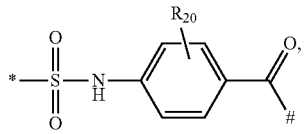

-continued

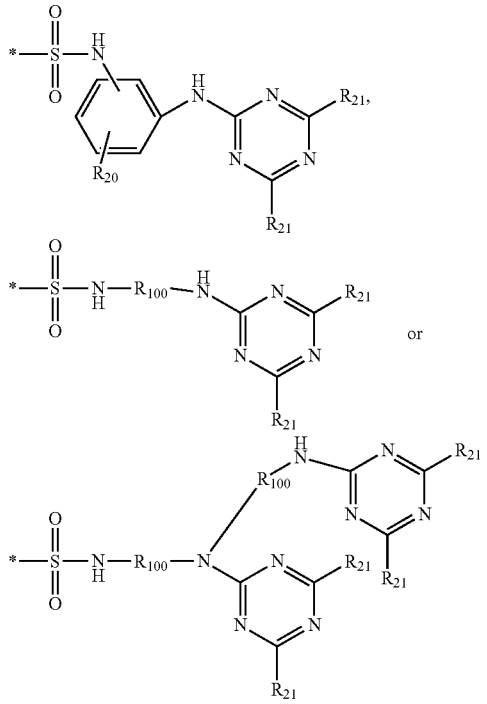

wherein $R_{20}$ is hydrogen, $C_1$-$C_8$ alkyl, $C_1$-$C_8$alkoxy or halogen;

$R_{21}$ is independently D, hydrogen, OH, Cl or F, with the proviso that at least one is D;

$R_{100}$ is $C_1$-$C_8$ alkylene

* is the point of attachment of PHC;

# is the point of attachment of the dye.

The aforementioned fabric shading dyes can be used in combination (any mixture of fabric shading dyes can be used).

The benefit agent may be a polymer, preferably an ester-bond containing polymer.

The benefit agent may be a surfactant. Suitable surfactants include fatty acid methyl ester ethoxylate surfactants.

The composition may comprise from 0.0001% to 30%, or even from 0.0001% to 20%, or even from 0.001% to 10% or even from 0.01% to 1% or even from 0.01% to 0.1% by weight of the composition of the benefit agent.

The composition may be a multicompartment unit dose article. In which case, the benefit agent may be present at a concentration of from 0.0001% to 30%, or even from 0.0001% to 20%, or even from 0.001% to 10%, or even from 0.01% to 1%, or even from 0.01% to 0.1%, by weight of the unit dose article. Alternatively, the benefit agent may be present in just one compartment, or be present at different concentrations between the different compartments. In such a case, the benefit agent may be present at a concentration of between 0.00001% to 50%, or even from 0.0001% to 30%, or even from 0.0001% to 20%, or even from 0.001% to 10%, or even from 0.01% to 1%, or even from 0.01% to 0.1%, by weight of the compartment. Preferably, the benefit agent is present in any compartment in which the aprotic solvent is present. Preferably, the compartment of a multi-compartment unit dose article that contains the highest concentration of the benefit agent comprises enough aprotic solvent such that the weight ratio of aprotic solvent to benefit agent in that compartment is from 2:1 or even from 4:1, or even from 6:1, to 8:1, or to 100:1, or to 250:1.

Aprotic Solvent

In the context of the present invention, a solvent is any substance that dissolves a solute to produce a solution. In the context of the present invention, an aprotic solvent is a solvent that cannot donate hydrogen. Preferably, the aprotic solvent is a polar aprotic solvent, wherein a polar aprotic solvent is an aprotic solvent that has a dipole moment.

Preferably, the aprotic solvent is selected from aprotic solvents that have a molecular weight of between 70 and 250, or even between 90 and 200, or even between 100 and 175, or even between 100 and 150. Mixtures of aprotic solvents may be used.

A preferred aprotic solvent may be a non-surfactant aprotic solvent, preferably a non-surfactant polar aprotic solvent. A preferred aprotic solvent may be a non-perfume aprotic solvent, preferably a non-perfume polar aprotic solvent.

The aprotic solvent may be selected from ethers, carbonate esters and combinations thereof. Preferably, the aprotic solvent is selected from propylene glycol carbonate, butylene glycol carbonate, polyether molecules or a combination thereof. Preferably the polyether molecules are diether molecules. Especially preferred diether molecules include dipropylene glycol dimethyl ether. When the aprotic solvent is a diether molecule, preferably it has a molecular weight of 500 or less, or even from 40 to 500, or even from 80 to 400.

The aprotic solvent may be propylene glycol carbonate.

The composition may comprise from 0.01 to 10%, or even from 0.01 to 5% or even from 0.01 to 2% by weight of the composition of the aprotic solvent.

The composition may be a multicompartment unit dose article. In which case, the aprotic solvent is present at a concentration of from 0.01 to 10%, or even from 0.01 to 5% or even from 0.01 to 2% by weight of the unit dose article. Alternatively, the aprotic solvent may be present in just one compartment, or be present at different concentrations between the different compartments. Preferably, the aprotic solvent is present in any compartment in which the benefit agent is present. Preferably, the compartment of a multi-compartment unit dose article that contains the highest concentration of the benefit agent comprises enough aprotic solvent such that the weight ratio of aprotic solvent to benefit agent in that compartment is from 2:1 or even from 4:1, or even from 6:1, to 8:1, or to 100:1, or to 250:1

Detergent Adjunct Ingredients

The composition may comprise water. If water is present it is preferably present at a concentration of less than 50% by weight of the composition. Water may be present at a concentration of between 2% and 35%, or even from 3% to 15% by weight of the composition.

The composition may further comprise a protic solvent.

It was surprisingly found, that the benefit of improved stability was observed even in the presence of protic solvents, including water.

The composition may comprise other common detergent adjunct ingredients. Preferably, the composition comprises other common laundry detergent composition adjunct ingredients. Suitable detergent adjunct ingredients include: detersive surfactants including anionic detersive surfactants, nonionic detersive surfactants, cationic detersive surfactants, zwitterionic detersive surfactants, amphoteric detersive surfactants, and any combination thereof; polymers including carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof; builders including zeolites, phosphates, citrate, and any combination thereof; buffers and alkalinity sources including carbonate salts and/or silicate salts; fillers including sulphate salts and bio-filler materials; bleach including bleach activators, sources of available oxygen, pre-formed peracids, bleach catalysts, reducing bleach, and any combination thereof; chelants; photobleach; shading dyes; brighteners; enzymes including proteases, amylases, cellulases, lipases, xyloglucanases, pectate lyases, mannanases, bleaching enzymes, cutinases, and any combination thereof; fabric softeners including clay, silicones, quaternary ammonium fabric-softening agents, and any combination thereof; flocculants such as polyethylene oxide; perfume including starch encapsulated perfume accords, perfume microcapsules, perfume loaded zeolites, Schiff base reaction products of ketone perfume raw materials and polyamines, blooming perfumes, and any combination thereof; aesthetics including soap rings, lamellar aesthetic particles, gelatin beads, carbonate and/or sulphate salt speckles, coloured clay, and any combination thereof: and any combination thereof.

Film

When the composition is a water-soluble unit-dose, it preferably comprises a film. The film of the unit dose article is soluble or dispersible in water, and preferably has a water-solubility of at least 50%, preferably at least 75% or even at least 95%, as measured by the method set out here after using a glass-filter with a maximum pore size of 20 microns:

50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred film materials are polymeric materials. The film material can be obtained, for example, by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are polymers which are from about 60% to about 98% hydrolysed, preferably about 80% to about 90% hydrolysed, to improve the dissolution characteristics of the material. Preferred films exhibit good dissolution in cold water, meaning unheated water straight from the tap. Preferably such films exhibit good dissolution at temperatures below 25° C., more preferably below 21° C., more preferably below 15° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M9467, M8310, films described in U.S. Pat. No. 6,166,117 and U.S. Pat. No. 6,787,512 and PVA films of corresponding solubility and deformability characteristics. Further preferred films are those describes in US2006/0213801, WO 2010/119022 and U.S. Pat. No. 6,787,512.

Preferred water soluble films are those resins comprising one or more PVA polymers, preferably said water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 cP (cP mean centipoise), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20.deg.C. All viscosities specified herein in cP should be understood to refer to the viscosity of 4% aqueous polyvinyl alcohol solution at 20.deg.C, unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PV A resin contains less than about 30 wt. % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PV A resin contains less than about 30 wt. % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt. % of a first PVA polymer that has a viscosity in a range of about 10 to about 15 cP and a degree of hydrolysis in a range of about 84% to about 92%. Another type of embodiment is characterized by the PVA resin including about 45 to about 55 wt. % of the first PVA polymer that has a viscosity in a range of about 10 to about 15 cP and a degree of hydrolysis in a range of about 84% to about 92%. The PVA resin can include about 15 to about 60 wt. % of the second PVA polymer that has a viscosity in a range of about 20 to about 25 cP and a degree of hydrolysis in a range of about 84% to about 92%, One contemplated class of embodiments is characterized by the PVA resin including about 45 to about 55 wt. % of the second PVA polymer.

When the PVA resin includes a plurality of PVA polymers the PDI value of the PVA resin is greater than the PDT value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

Preferably the PVA resin has a weighted, average degree of hydrolysis ($\overline{H^{\circ}}$) between about 80 and about 92%, or between about 83 and about 90%, or about 85 and 89%. For example, $\overline{H^{\circ}}$ for a PVA resin that comprises two or more PVA polymers is calculated by the formula $\overline{H^{\circ}}=\Sigma(Wi\cdot H_i)$ where $W_i$ is the weight percentage of the respective PVA polymer and a $H_i$ is the respective degrees of hydrolysis. Still further it is desirable to choose a PVA resin that has a weighted log viscosity ($\overline{\mu}$) between about 10 and about 25, or between about 12 and 22, or between about 13.5 and about 20. The $\overline{\mu}$ for a PVA resin that comprises two or more PVA polymers is calculated by the formula $\overline{\mu}=e^{\Sigma W_i \cdot ln\ \mu_i}$ where $\mu_t$ is the viscosity for the respective PVA polymers.

Yet further, it is desirable to choose a PVA resin that has a Resin Selection Index (RSI) in a range of 0.255 to 0.315, or 0.260 to 0.310, or 0.265 to 0.305, or 0.270 to 0.300, or 0.275 to 0.295, preferably 0.270 to 0.300. The RSI is calculated by the formula; $\Sigma(W_i|\mu_i-\mu_t|)/\Sigma(W_i\mu_i)$, wherein $\mu_t$ is seventeen, $\mu_i$ is the average viscosity each of the respective PVOH polymers, and $W_i$ is the weight percentage of the respective PVOH polymers.

Even more preferred films are water soluble copolymer films comprising a least one negatively modified monomer with the following formula:

$$[Y]\text{-}[G]_n$$

wherein Y represents a vinyl alcohol monomer and G represents a monomer comprising an anionic group and the index n is an integer of from 1 to 3. G can be any suitable comonomer capable of carrying of carrying the anionic group, more preferably G is a carboxylic acid. G is preferably selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid and mixtures thereof.

The anionic group of G is preferably selected from the group consisting of $OSO_3M$, $SO_3M$, $CO_2M$, $OCO_2M$, $OPO_3M_2$, $OPO_3HM$ and $OPO_2M$. More preferably anionic group of G is selected from the group consisting of $OSO_3M$, $SO_3M$, $CO_2M$, and $OCO_2M$. Most preferably the anionic group of G is selected from the group consisting of $SO_3M$ and $CO_2M$.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including water, to be delivered to the wash water, for example organic polymeric dispersants, etc.

Method of Making

The present invention is also to a method of making a composition according to the present invention, wherein the composition is prepared by;

a) Obtaining a pre-mix comprising the benefit agent and the aprotic solvent;

b) mixing the pre-mix with the adjunct ingredient;

c) Optionally adding one or more further ingredients in one or more further steps;

d) Collecting the final composition.

Optionally, the pre-mix can be added to an open pouch made from a water-soluble film, which is then sealed, preferably with a second water-soluble film. The pre-mix may optionally be mixed with one or more further ingredients in one or more further steps before being added to the open pouch.

Alternatively, the pre-mix may be added to one compartment of a multicompartment pouch. In which case the premix may be added to a first compartment which is sealed and said sealed compartment is used to seal a second compartment. Alternatively, the pre-mix may be added to an open first compartment which is then sealed with a second film comprising a closed compartment.

Preferably, the benefit agent in the pre-mix is a shading dye. Preferably the aprotic solvent in the pre-mix is propylene glycol carbonate.

Method of Washing

The compositions pouches of the present invention are suitable for cleaning applications, particularly laundry applications. The compositions are suitable for hand or machine washing conditions. When machine washing, the composition may be delivered from the dispensing drawer or may be added directly into the washing machine drum. The composition may be used in combination with other fabric treatment compositions.

EXAMPLES

The benefit agent for Examples I and II is Dye A:

Dye A

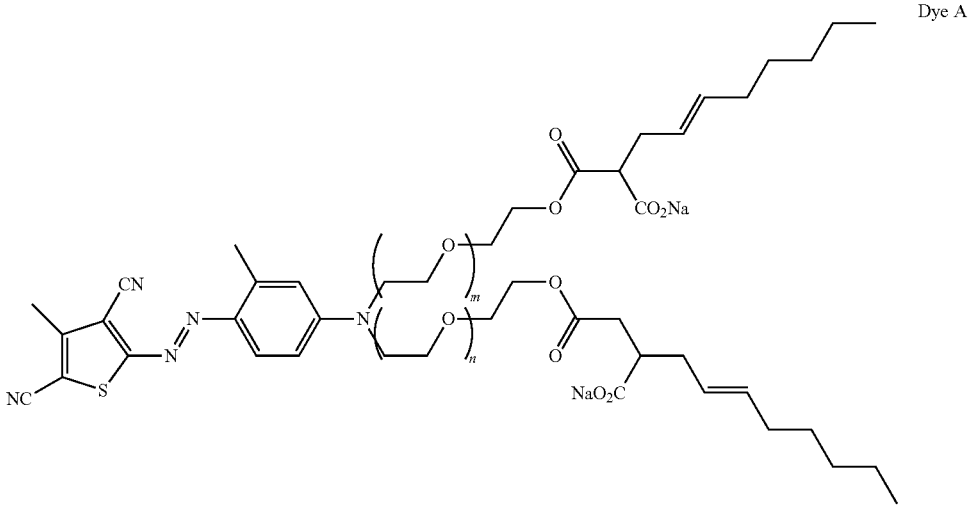

Dye A is a mixture of ethoxylate chain lengths ranging from about 3 to about 10 with an average value of between 5 and 6, such that (m+n)=about 1 to about 8, with an average of (m+n)=between 3 and 4.

The dye shown immediately below results from hydrolysis of both of the hydrolytically unstable ester bonds in the dye shown above.

Dye C

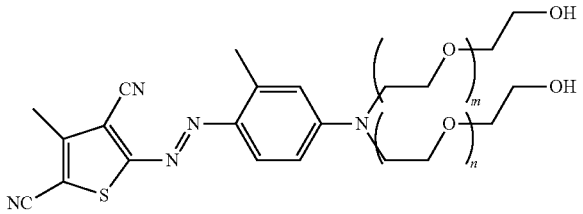

As was the case for Dye A above, Dye C is a mixture of ethoxylate chain lengths ranging from about 3 to about 10 with an average value of between 5 and 6, such that (m+n)=about 1 to about 8, with an average of (m+n)=between 3 and 4.

The more susceptible to hydrolysis Dye A is under a given condition, the more Dye C will be formed.

Example I

Fresh solutions of Dye A were prepared in one of two solvents; either PEG 200 or propylene carbonate. From these two Dye A solutions, premixes were formed with the following composition:

| | |
|---|---|
| Dye A solution | 12 wt % |
| Non-ionic (C24EO9) | 16 wt % |
| Propylene glycol | 72 wt % |

Example II

Fresh samples of the premixes prepared for Example I above were used to make pouched Unit Dose detergents, where the premixes were part of a typical formulation used in the top compartment of a multi-pouch unit dose product. The formulation comprised about 5 wt % premix along with a mixture of 47% surfactant (composed of 30% of a mixture of NI 24-7 and NI 45-7, 40% LAS and 30% C24 AE3S) along with 20% additives (a mixture of builders, brighteners, chelants, rheology modifier and soil suspending polymer), and 28% solvents and stabilizers (primarily propane diol, glycerine, and ethanolamine).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 μm" is intended to mean "about 40 μm."

The invention claimed is:

1. A composition comprising;

a. a benefit agent, wherein the benefit agent comprises at least one hydrolytically unstable bond, wherein the benefit agent is a shading dye, and wherein the at least one hydrolytically unstable bond is selected from esters, thioesters and amides of organic acids; and b. a non-perfume aprotic solvent.

2. The composition according to claim 1, wherein the hydrolytically unstable bond is of the formula X—Y, wherein at least one of X and/or Y are a heteroatom, that can hydrolyze to yield X—OH and H—Y.

3. The composition according to claim 1, wherein the shading dye is a blue or violet shading dye.

4. The composition according to claim 3, wherein the shading dye comprises an anionic group covalently bound to an alkoxy group.

5. The composition according to claim 3, wherein the shading dye is selected from a polymeric thiophene dye.

6. The composition according to claim 1, wherein the benefit agent is a shading dye, and wherein the shading dye may be the purified shading dye, or may be the shading dye in combination with impurities from the synthesis of the shading dye.

7. The composition according to claim 1, wherein the aprotic solvent is selected from ethers, carbonate esters and combinations thereof.

8. The composition according to claim 7, wherein the aprotic solvent is selected from propylene glycol carbonate, butylene glycol carbonate, diether molecules and combinations thereof.

9. The composition according to claim 1, wherein the ratio of aprotic solvent to benefit agent is from 2:1 to 100:1.

10. The composition according to claim 1, wherein the composition comprises from 0.01 to 10% by weight of the composition of the aprotic solvent.

11. The composition according to claim 1, wherein the ratio of aprotic solvent to benefit agent is from 4:1 to 8:1.

12. The composition according to claim 1, wherein the composition comprises from 0.01 to 5% by weight of the composition of the aprotic solvent.

13. The composition according to claim 1, wherein the composition comprises from 0.01 to 2% by weight of the composition of the aprotic solvent.

14. The composition according to claim 1, wherein the at least one hydrolytically unstable bond is selected from:

a. bonds of the formula X—Y, wherein at least one of X and/or Y are a heteroatom, that can hydrolyze to yield:

i. X—OH and $CO_2$ and HM-Y or X—OH and H—Y, wherein M=O, N, or S, or ii. X-Nu and H—Y where Nu=Heteroatom-$R_xR_yR_z$, wherein x, y, z are integers independently selected from 0 or 1 and x+y+z 1, and wherein Rx, $R_y$ and $R_z$ are independently selected from the group consisting of H, alkyl, alkoxy, alkyleneoxy, alkyl capped alkyleneoxy, polyalkyleneoxy, alkyl capped polyalkyleneoxy, urea, or amido;

b. bonds of the formula X—Y—Z, wherein at least one of X and/or Z are a heteroatom, that can hydrolyze to yield X—Y—OH and H—Z or X—Y-Nu and H—Z wherein Nu=Heteroatom-$R_xR_yR_z$, wherein x, y, z are integers independently selected from 0 or 1 and $x+y+z \geq 1$, wherein Rx, $R_y$ and $R_z$ are independently selected from the group consisting of H, alkyl, alkoxy, alkyleneoxy, alkyl capped alkyleneoxy, polyalkyleneoxy, alkyl capped polyalkyleneoxy, urea, or amido, and wherein Y is selected from alkyl, carbocycle, heterocycle, aromatic, or heteroaromatic groups; or c. mixtures thereof.

* * * * *